US010695643B1

(12) United States Patent
Elker

(10) Patent No.: US 10,695,643 B1
(45) Date of Patent: Jun. 30, 2020

(54) PUTTING TRAINING AID

(71) Applicant: Robert J. Elker, Hatfield, PA (US)

(72) Inventor: Robert J. Elker, Hatfield, PA (US)

( * ) Notice: Subject to any disclaimer, the term of this patent is extended or adjusted under 35 U.S.C. 154(b) by 0 days.

(21) Appl. No.: 16/507,274

(22) Filed: Jul. 10, 2019

(51) Int. Cl.
*A63B 69/36* (2006.01)

(52) U.S. Cl.
CPC ..... *A63B 69/3685* (2013.01)

(58) Field of Classification Search
CPC ..... A63B 69/3685; A63B 2053/0433; A63B 53/0487; A63B 53/007; A63B 22/20; A63B 69/3632; A63B 53/04
USPC ..... 473/226, 230, 231, 324, 325, 330, 340
See application file for complete search history.

(56) References Cited

U.S. PATENT DOCUMENTS 2,084,902 A * 6/1937 Eisenberg ..... A63B 69/3676 473/229
D113,690 S * 3/1939 Tresenberg ..... D28/7
2,702,917 A * 3/1955 Lynden ..... B05C 17/0217 15/230.11
3,319,964 A * 5/1967 Steinberg ..... A63B 69/3685 473/230
3,471,155 A * 10/1969 Donaldson ..... A63B 69/3676 473/260
4,535,992 A * 8/1985 Slagle ..... A63B 69/3685 473/230
5,362,056 A * 11/1994 Minotti ..... A63B 53/0487 473/251
5,527,035 A * 6/1996 Marshall ..... A63B 69/3685 473/230
5,577,965 A * 11/1996 Burgess ..... A63B 53/0487 473/230
5,603,665 A * 2/1997 Bryant ..... A63B 53/0487 273/DIG. 30
6,066,053 A * 5/2000 Sehemberger ..... A63B 53/0487 473/230
6,721,988 B2 * 4/2004 Woodruff ..... B05C 17/02 15/230.11
6,767,293 B2 * 7/2004 Pechter ..... A63B 53/007 473/313
7,172,516 B2 * 2/2007 Wu ..... A63B 69/0057 473/219
7,604,546 B2 * 10/2009 Brown ..... A63B 53/0487 473/230
8,920,260 B1 * 12/2014 Azmudeh ..... A63B 53/02 473/329
2005/0059505 A1 * 3/2005 Montalembert ... A63B 69/3623 473/230
2005/0153791 A1 * 7/2005 Massey ..... A63B 53/0487 473/328

* cited by examiner

*Primary Examiner* — Nini F Legesse
(74) *Attorney, Agent, or Firm* — Messina Pat. & TM Law PLLC

(57) ABSTRACT

A putting training aid includes a weighted roller assembly. The weighted roller assembly includes a bracket member and a weighted roller mounted relative to the bracket member such that the roller is rotatable about a central axis relative to the bracket member. The roller has a weight of at least 18 ounces. A connection is configured for connection of a putter shaft to the bracket member. The connection may be through a direct connection to the bracket member. The connection may be through a support tray connected to the bracket member.

17 Claims, 7 Drawing Sheets

PUTTING TRAINING AID

FIELD OF THE INVENTION

This invention relates to putting training aids. More particularly, the invention relates to weighted, rolling putting training aids.

BACKGROUND OF THE INVENTION

Typically, in playing golf, a poor putter may make one or both of two kinds of errors in form.

One such error is that the golfer, in swinging back the putter prior to the hit, lifts up the putter as in a normal swing with a wood or iron golf club; and this type of golfer often also lifts up the putter as soon the golf ball is struck in putting. These "not-flat" errors are frequent in spite of the fact that the standard wisdom in putting is to move the putter in a flat "sweeping" motion.

Another such error is that the golfer turns the golfer's body while putting, and in the same way, again, as if in a normal swing with a wood or iron golf club. So, typically, such golfer, even if "sweeping" the putter head in a flat plane (thus not making the first kind of error mentioned above), brings back the putter head in an arc preparatory to the hit; and this type of golfer also follows through after the hit in an arc. These "not-straight" errors are frequent in spite of the fact that the standard wisdom in putting is to move the putter in a straight line through the hitting area of the putt (including before the putt hit and after the putt hit). Since a "good" putting motion is so different from a "good" wood-club swing or iron-club swing, it would be helpful to provide a tool or device to assist in training golfers to feel the difference and to practice doing putting with a flat and straight "sweeping" motion.

Accordingly, there is a need for a putting training aid which trains the user to make a low, straight putting stroke.

SUMMARY OF THE INVENTION

In at least one embodiment, the present invention provides a putting training aid including a weighted roller assembly. The weighted roller assembly includes a bracket member and a weighted roller mounted relative to the bracket member such that the roller is rotatable about a central axis relative to the bracket member. The roller has a weight of at least 18 ounces. A connection is configured for connection of a putter shaft to the bracket member.

In at least one embodiment, the present invention provides a putting training aid including a weighted roller assembly. The weighted roller assembly includes a bracket member and a weighted roller mounted relative to the bracket member such that the roller is rotatable about a central axis relative to the bracket member. The roller has a weight of at least 18 ounces. A support tray is attached to the bracket member and defines a receiving area configured to receive a putter head therein. An attachment mechanism is configured to secure a putter head received within the receiving area.

In at least one embodiment, the present invention provides a putting training aid including a weighted roller assembly. The weighted roller assembly includes a bracket member and a weighted roller mounted relative to the bracket member such that the roller is rotatable about a central axis relative to the bracket member. The roller has a weight of at least 18 ounces.

A putter shaft is connected to the bracket member.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
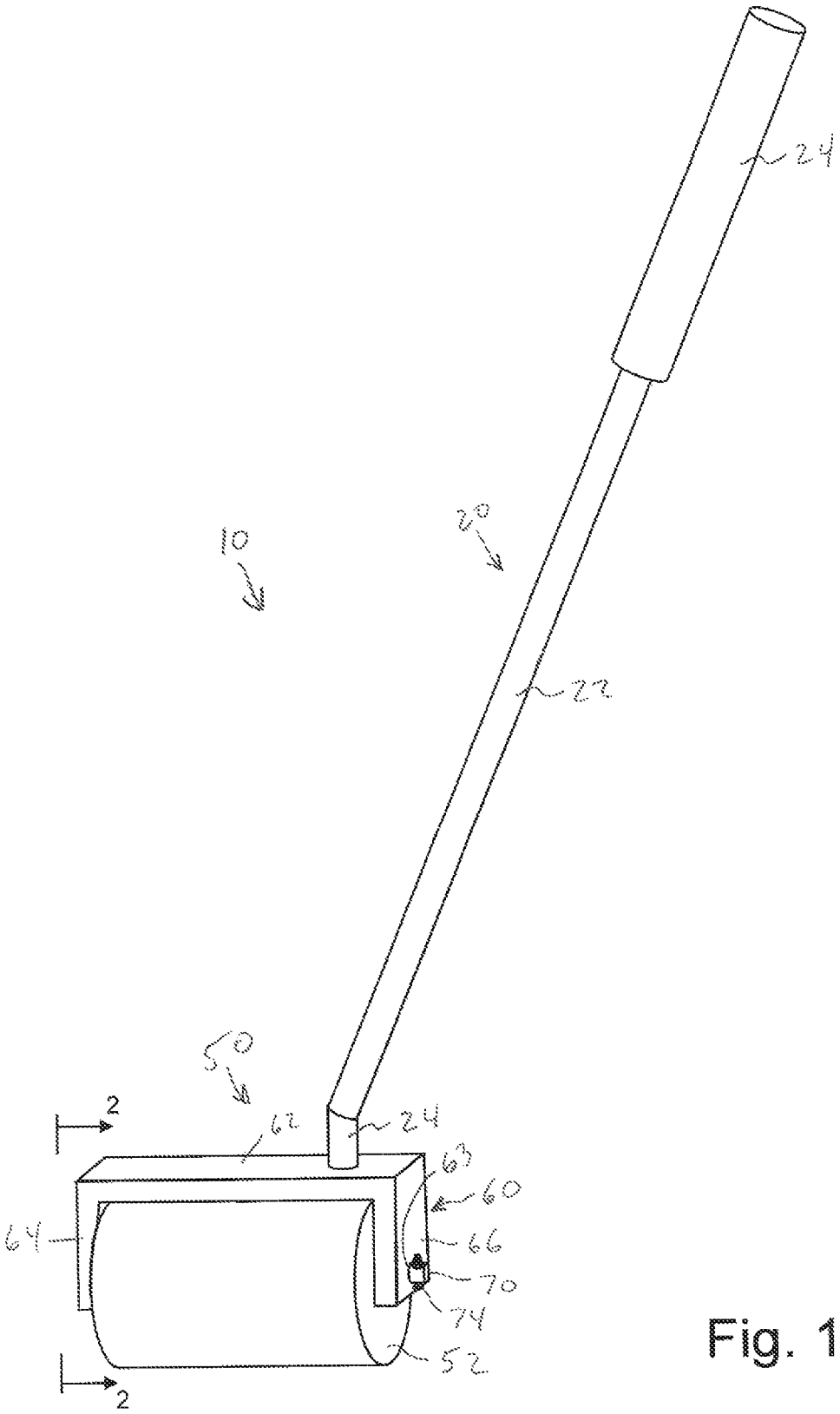
FIG. 1 is a perspective view of a putting training aid in accordance with an embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
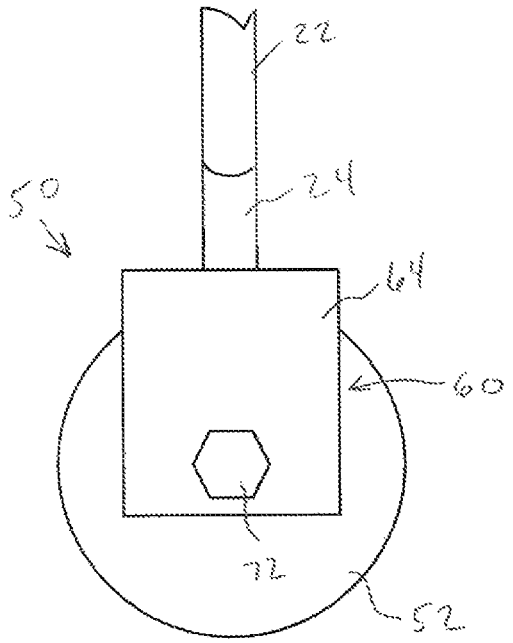
FIG. 2 is an elevation view along the line 2-2 in FIG. 1.
Figure 3:
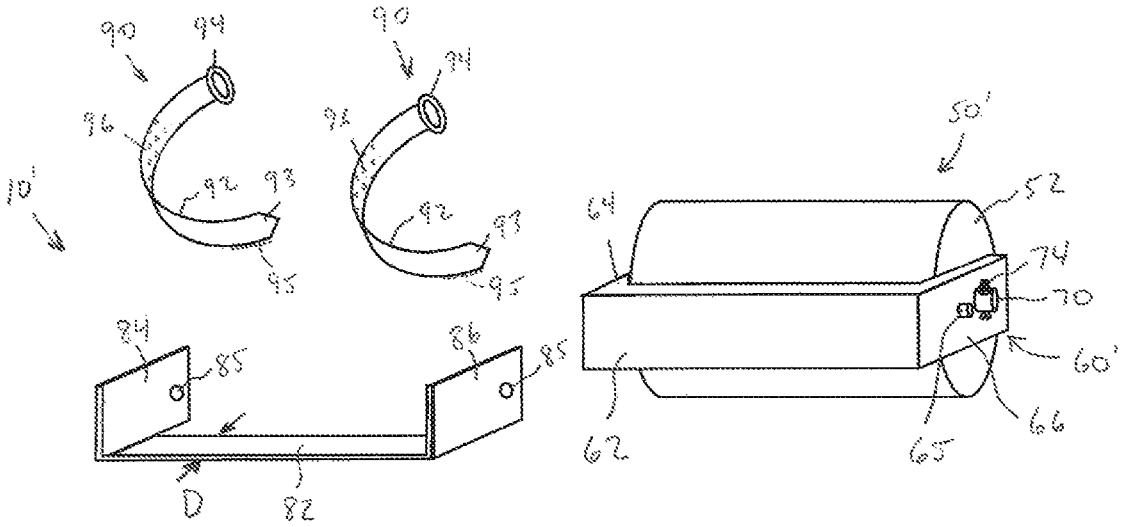
FIG. 3 is an exploded perspective view of a putting training aid in accordance with another embodiment of the invention.

Referring to FIGS. 1 and 2, a putting training aid 10 in accordance with an embodiment of the invention will be described. In the present embodiment, the putting training aid 10 is a unitized structure including a shaft 20 and a weighted roller assembly 50 attached thereto. The shaft 20 is similar to a putter shaft and includes an elongate shaft 22 extending from a grip 24 to a connection end 24. The shaft 20 may have various configurations and is not limited to the illustrated angled configuration.

In the present embodiment, the weighted roller assembly 50 includes a weighted roller 52 secured to a bracket member 60. Most putter heads are defined as standard at approximately 350 grams (12.35 ounces). The weighted roller 52 of the present invention has a weight that is at least 50% greater than that of a standard head, namely, at least 18 ounces. More preferably, the weighted roller 52 has a weight between 25 and 64 ounces, and most preferably, has a weight between 32 and 56 ounces. As will be described in more detail hereinafter, the weighted roller 52 is preferably mounted to the bracket member 60 in an interchangeable manner so different roller weights may be used for different users, for example, for a junior player vs a college player vs a senior player. While not illustrated, the weighted roller 52 has a passage extending therethrough along the central axis of the roller. The passage is configured to receive a mounting pin 70 such that the roller 52 rolls smoothly and evenly about the mounting pin 70. Bearings may provided within the passage to facilitate the smooth, even rolling motion. The roller 52 may be manufactured from various materials, for example, various metals including steel, various elastomeric materials including silicone and rubber and various plastics or other polymers.

The illustrated bracket member 60 has a u-shaped configuration with a main bar 62 extending between a pair of depending legs 64, 66. While the illustrated bracket member includes a pair of legs, the bracket member 60 is not limited to such and may have other configurations, for example, a single leg extending to one end of the roller 52. The connection end 24 of the shaft 22 is secured to the main bar 62, typically closer to one of the legs, however, the connection may be made anywhere along the main bar 62. The connection may be a generally permanent connection, e.g. welding, or an interchangeable connection, e.g. threaded connection. Each leg 64, 66 defines a through bore 63 configured for passage of the mounting pin 70. To mount the weighted roller 52 to the bracket member 60, the mounting pin 70 is extended through one of the through bores 62, through the roller passage and through the other through bore 63. As shown in FIG. 2, one end of the mounting pin 70 may include a head 74 having a size larger than the through bore 63. The opposite end of the mounting pin 70 is preferably configured for a releasable connecting member. In the illustrated embodiment, a cotter pin hairpin 74 extends through a bore in the end of the mounting pin 70. Other releasable connecting members may be utilized, for example, a threaded nut configured to engage corresponding threads on the mounting pin. The releasable nature of the mounting pin connecting member allows the weighted roller 52 to be interchanged, for example, to change weights.

As seen with reference with reference to FIGS. 1 and 2, the surface of the roller 52 extends forward of the shaft 22 and will contact the ball when the putting aid 10 is utilized to practice the putting stroke. Additionally, the shaft 22 connection to the bracket member 60 which is pivotally connected to the weighted roller 52 allows the shaft 22 to tilt relative to the roller 52 during both the back and forward strokes. As such, during the full stroke, the roller 52 will roll smoothly along the practice surface, whether a putting green or other practice area. The weight of the weighted roller 52 causes the user to maintain a low, straight stroke, as desired. It is noted that the training aid 10 may be utilized by a right-handed or left-handed player.

Turning to FIGS. 3-7, a putting training aid 10' in accordance with another embodiment of the invention will be described. In the present embodiment, the training aid 10' does not include an integral shaft, but instead is configured for attachment to a user's personal putter. The training aid 10' generally comprises a weighted roller assembly 50', a support tray 80 and one or more putter attachment mechanisms 90. The weighted roller assembly 50' is similar to the previous embodiment and includes a weighted roller 52 and a bracket member 60'. The weighted roller 52 may be the same weight as in the previous embodiment or may be slightly lighter with the attached putter head providing the additional weight. The bracket member 60' is substantially the same as in the previous embodiment with the exception that it includes a pair of mounting pegs 65, one extending outwardly from each leg 64, 66. The mounting pegs 65 facilitate attachment of the support tray 80 as will be described in detail hereinafter.

Figure 4:
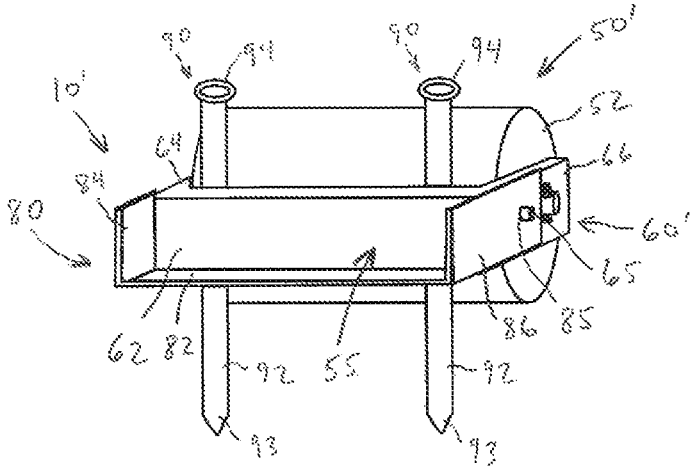
FIG. 4 is a perspective view of the putting training aid of FIG. 3.

The support tray 80 of the present embodiment is configured to support a standard blade style putter head 26. The tray 80 includes a support plate 82 with arms 84 and 86 extending from each end of the support plate 82 generally perpendicular thereto. The support plate 82 has a depth D which is slightly smaller than the depth of a standard blade style putter head 26. Each of the arms 84, 86 extends rearwardly of the rear edge of the support plate 82. A mounting bore 85 is defined through the rear end of each of the arms 84, 86. Each of the mounting bores 85 is configured to receive a respective mounting peg 65 to attach the support tray 80 to the bracket member 60'. The arms 84, 86 may flair outwardly as the pegs 65 are moved into alignment with the bores 85. As shown in FIG. 4, with the support tray 80 attached to the bracket member 60', the rear edge of the support plate 82 contacts the main bar 62 and a putter head receiving area 55 is defined by the support plate 82, the arms 84, 86 and the main bar 62. While the present embodiment shows the support plate 82 contacting the face of the main bar 62, such is not required, and instead the support plate 82 may have a larger depth such that a portion of the support plate extends under and contacts the lower surface of the main bar 62. In either case, the receiving area 55 has a depth from the main bar 62 to the front edge of the support plate 82 that is less than the depth of a standard blade style putter head 26 such that when the putter head 26 is positioned in the receiving area 55, the front face 28 thereof will be forward of the tray 80 and in a position to strike a ball (see FIGS. 6 and 7).

Figure 5:
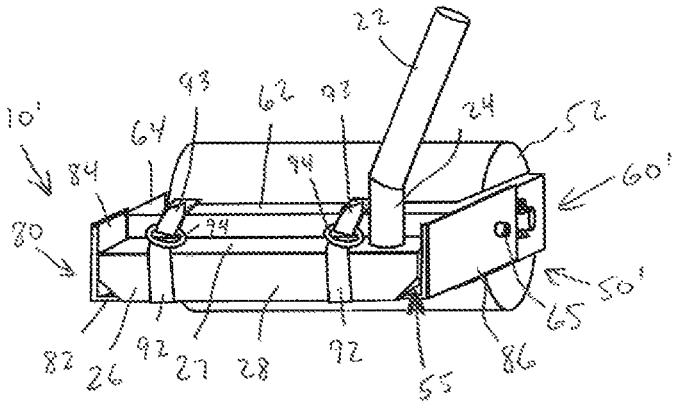
FIG. 5 is a perspective view of the putting training aid of FIG. 3 with a standard putter attached thereto.
Figure 6:
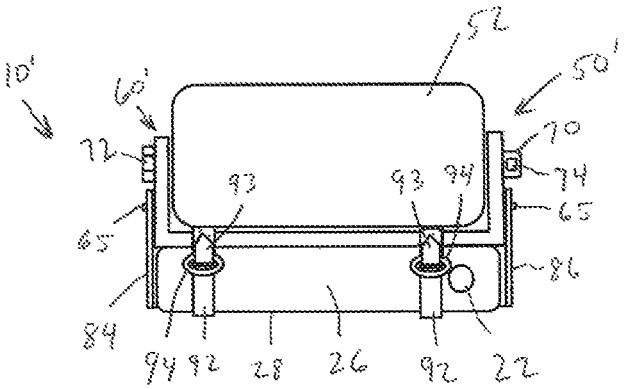
FIG. 6 is a top plan view of the putting training aid of FIG. 3 with a standard putter attached thereto.
Figure 7:
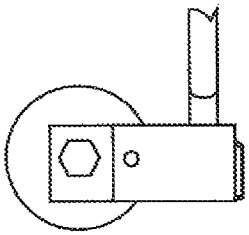
FIG. 7 is an end elevation view of the putting training aid of FIG. 3 with a standard putter attached thereto.

In the present embodiment, the putter attachment mechanisms 90 include a pair of straps 92 extending from a free end 93 to a loop end 94. In the illustrated embodiment, a portion of the strap 92 includes hook fasteners 95 while another portion of the strap 92 includes loop fasteners 96. Referring to FIG. 4, each strap 92 is extended between the main bar 62 and the roller 52. Once the putter head 26 is positioned in the receiving area 55, the free end 93 of each strap 92 is passed through the loop end 94 and the folded back into engagement with the strap 92 to secure the hook 95 and loop 96 fasteners, as shown in FIGS. 5-7. The straps 92 are preferably positioned toward the ends of the putter head so that the center of the face 28 is still free to contact the ball during use. The invention is not limited to the illustrated attachment mechanism and other devices may be utilized, for example, clips or set screws.

Referring to FIGS. 5-7, with the putter head 26 secured within the receiving area 55 of the training aid 10', the device will operate substantially as in the previous embodiment except that the user will be striking the ball with the face 28 of their own putter instead of with the roller 52. With this configuration, the user will be able to see their own putter head and further associate the trained stroke with their own putter. Again, because the bracket member 60' is pivotally connected to the weighted roller 52 and the support tray 80 is positioned off of the putting surface (see FIG. 7), the shaft 22 is permitted to tilt relative to the roller 52 during both the back and forward strokes. As such, during the full stroke, the roller 52 will roll smoothly along the practice surface, whether a putting green or other practice area. The weight of the weighted roller 52 causes the user to maintain a low, straight stroke, as desired. It is noted that the training aid 10' may be utilized by a right-handed or left-handed player.

Figure 8:
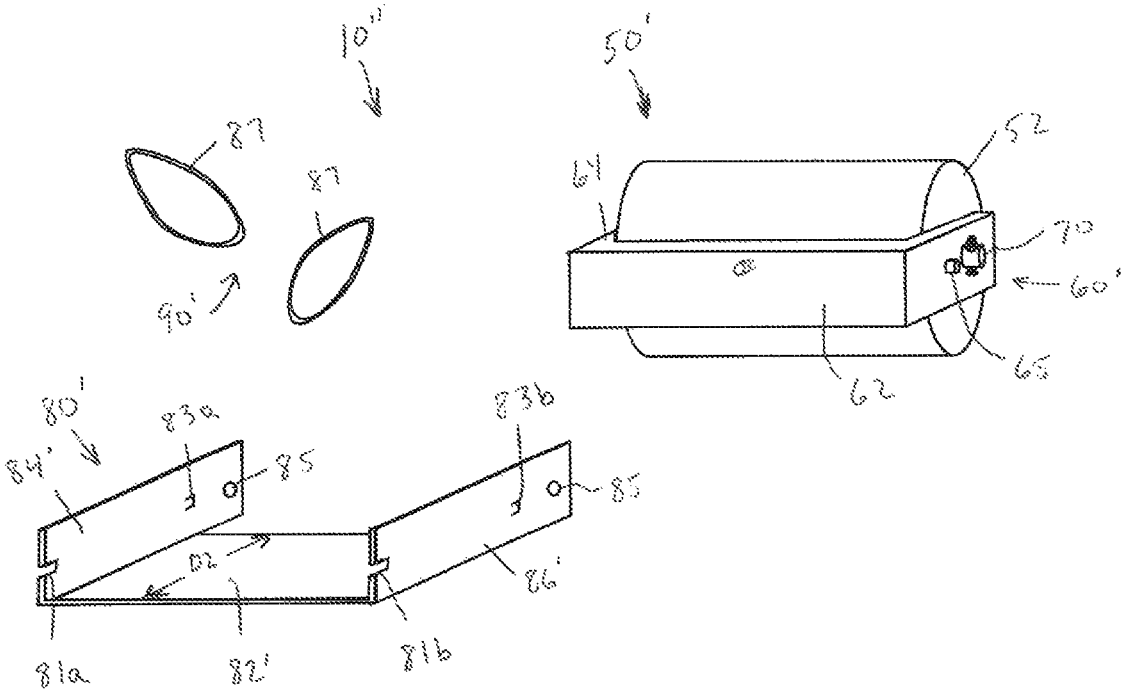
FIG. 8 is an exploded perspective view of a putting training aid in accordance with another embodiment of the invention.
Figure 9:
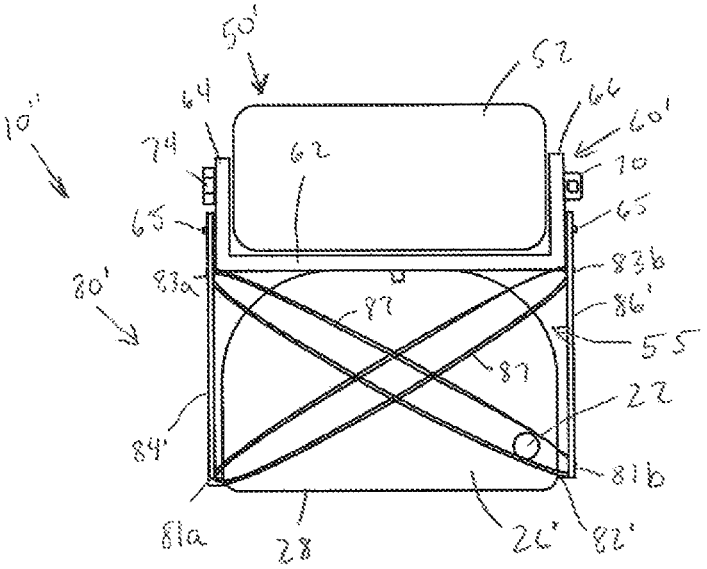
FIG. 9 is a top plan view of the putting training aid of FIG. 8 with a standard putter attached thereto.

Referring to FIGS. 8 and 9, a putting training aid 10" in accordance with another embodiment of the invention will be described. This putting training aid 10" is similar to the previous embodiment but is configured to attach to mallet style or similar putter heads 26' having a larger depth than a blade style putter head. The weighted wheel assembly 50' of this embodiment is the same as in the previous embodiment, however, the support tray 80' and the putter attachment mechanism 90' are modified. It is understood that the training aid may be provided as a kit with the weighted wheel assembly 50' and both of the trays 80, 80' and attachment mechanisms 90, 90' such that the user can modify the training aid to their current putter style.

As in the previous embodiment, the support tray 80' includes a support plate 82' with arms 84' and 86' extending from each end of the support plate 82' generally perpendicular thereto. The support plate 82' has a depth D2 which is slightly smaller than the depth of a mallet style putter head 26'. Each of the arms 84', 86' extends rearwardly of the rear edge of the support plate 82'. A mounting bore 85 is defined through the rear end of each of the arms 84', 86'. Each of the mounting bores 85 is configured to receive a respective mounting peg 65 to attach the support tray 80 to the bracket member 60'. The arms 84, 86 may flair outwardly as the pegs 65 are moved into alignment with the bores 85. As shown in FIG. 9, with the support tray 80' attached to the bracket member 60', the rear edge of the support plate 82' contacts the main bar 62 and a putter head receiving area 55 is defined by the support plate 82', the arms 84', 86' and the main bar 62. While the present embodiment shows the support plate 82' contacting the face of the main bar 62, such is not required, and instead the support plate 82' may have a larger depth such that a portion of the support plate extends under and contacts the lower surface of the main bar 62. In either case, the receiving area 55 has a depth from the main bar 62' to the front edge of the support plate 82' that is less than the depth of a mallet style putter head 26' such that when the putter head 26' is positioned in the receiving area 55, the front face 28 thereof will be forward of the tray 80' and in a position to strike a ball.

In the present embodiment, the putter attachment mechanism 90' includes a pair of elastic bands 87. The elastic bands 87 are configured to engage notches or tabs 81*a*, 83*a*, 81*b*, 83*b* defined in the arms 84, 86. One end of each elastic band 87 may be secured to a respective tab 83*a*, 83*b* prior to positioning of the putter head 26' within the receiving area 55. The putter head 26' is then positioned within the receiving area 55 and each elastic band 87 is stretched diagonally across the putter head 26' and secured in the notch 81*a*, 81*b* of the opposite arm 84', 86', i.e. one elastic band 87 extends from tab 83*a* to notch 81*b* and the other elastic band 87 extends from tab 83*a* to notch 81*b*. As illustrated, the putter shaft 22 may be extended through one of the elastic bands 87 prior to positioning of the putter head 26' in the receiving area 55.

As in the previous embodiment, with the putter head 26' secured within the receiving area 55 of the training aid 10", the device will operate substantially as in the first embodiment except that the user will be striking the ball with the face 28 of their own putter instead of with the roller 52. With this configuration, the user will again be able to see their own putter head and further associate the trained stroke with their own putter. Again, because the bracket member 60' is pivotally connected to the weighted roller 52 and the support tray 80' is positioned off of the putting surface, the shaft 22 is permitted to tilt relative to the roller 52 during both the back and forward strokes. As such, during the full stroke, the roller 52 will roll smoothly along the practice surface, whether a putting green or other practice area. The weight of the weighted roller 52 causes the user to maintain a low, straight stroke, as desired. It is noted that the training aid 10" may be utilized by a right-handed or left-handed player.

Figure 10:
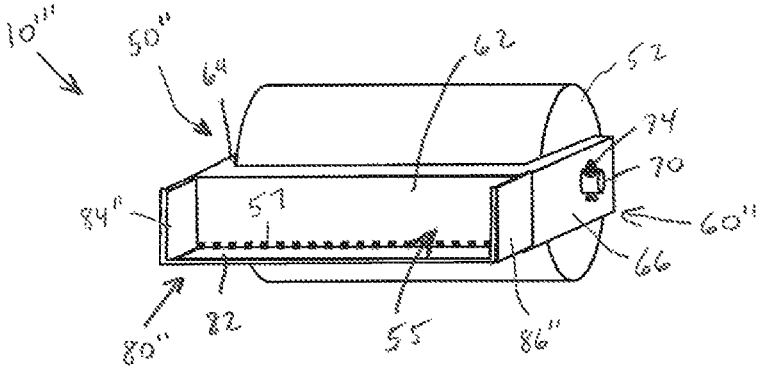
FIG. 10 is a perspective view of a putting training aid in accordance with another embodiment of the invention.
Figure 11:
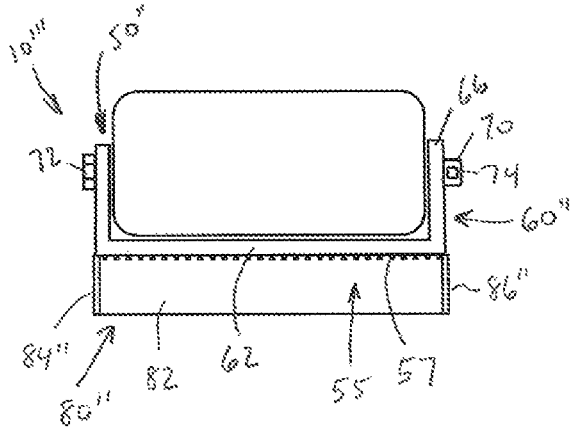
FIG. 11 is a top plan view of the putting training aid of FIG. 10.
Figure 12:
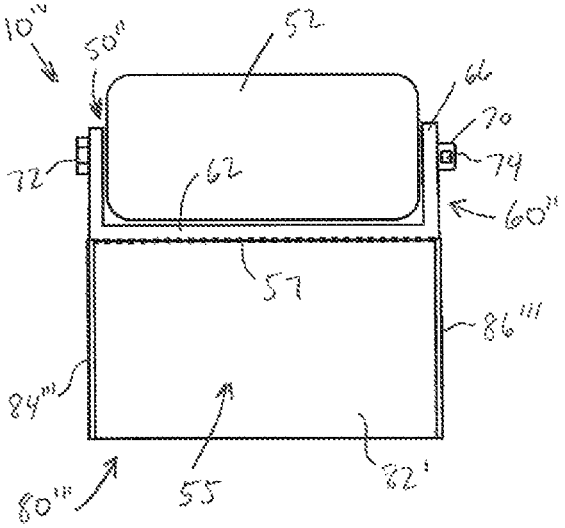
FIG. 12 is a top plan view of a putting training aid in accordance with another embodiment of the invention.

Referring to FIGS. 10-12, two training aids 10''' and 10$^{iv}$, which again may be sold in a kit as discussed below, will be described. The training aid 10''' shown in FIGS. 10 and 11 is similar to the training aid 10' of FIGS. 3-7 except that the support tray 80" is permanently mounted to the bracket member 60". As such, the bracket member 60" of the weighted roller assembly 50" does not include the mounting pegs, but in other respects, the roller assembly 50" is the same as the previous embodiments.

In the current embodiment, at least a portion of the rear edge of the support plate 82 of the support tray 80" is welded to the main bar 62 of the bracket member 60", as illustrated at 57. While a weld is described herein, it is recognized that other unitary structures may be utilized, for example, molding the bracket member and support tray as a unitary structure. Since the support tray 80" is connected through a permanent connection, the arms 84", 86" have a depth which is equal to the depth of the support plate 82 and do not including mounting bores. As in the earlier embodiment, a putter head receiving area 55 is defined between the main bar 62, the support plate 82 and the arms 84", 86" which will have a depth slightly smaller than that of a blade style putter head such that the face of the putter head extends forward of the support tray 80".

Referring to FIG. 12, the training aid 10$^{iv}$ is substantially the same as the training aid 80" described with respect to FIGS. 8 and 9 except that the support tray 80''' is permanently mounted to the bracket member 60". As such, the bracket member 60" of the weighted roller assembly 50" does not include the mounting pegs, but in other respects, the roller assembly 50" is the same as the previous embodiments.

In the current embodiment, at least a portion of the rear edge of the support plate 82' of the support tray 80''' is welded to the main bar 62 of the bracket member 60", as illustrated at 57. While is a weld is described herein, it is recognized that other unitary structures may be utilized, for example, molding the bracket member and support tray as a unitary structure. Since the support tray 80''' is connected through a permanent connection, the arms 84''', 86''' have a depth which is equal to the depth of the support plate 82' and do not including mounting bores. As in the earlier embodiment, a putter head receiving area 55 is defined between the main bar 62, the support plate 82 and the arms 84", 86" which will have a depth slightly smaller than that of a mallet style putter head such that the face of the putter head extends forward of the support tray 80'''. To provide both trays 80" and 80''' in a kit, each would be sold together with a weighted roller 52 and pin 70. To change the tray, the pin 70 would be removed, the bracket member 60" of the desired tray 80" or 80''' would be aligned with the roller 52 and the pin 70 reinserted.

Figure 13:
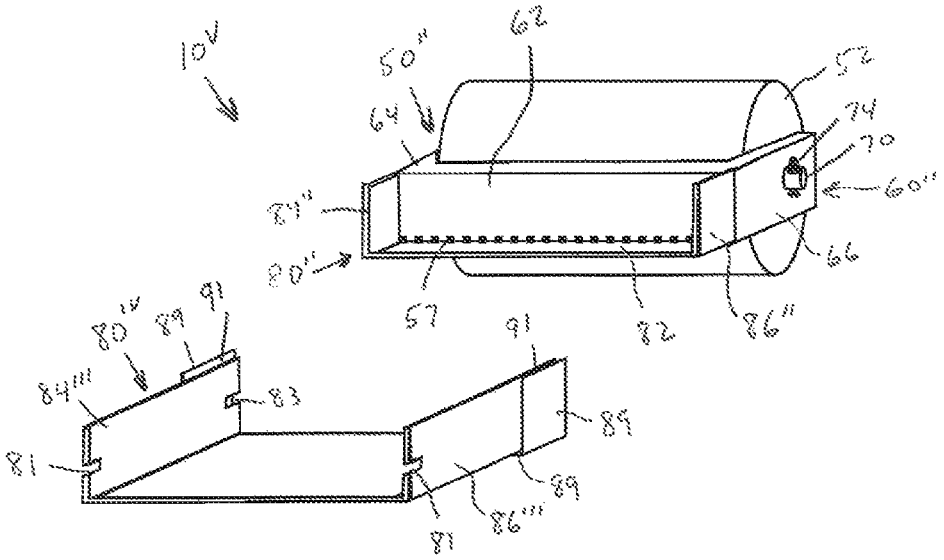
FIG. 13 is a partially exploded perspective view of a putting training aid in accordance with another embodiment of the invention.
Figure 14:
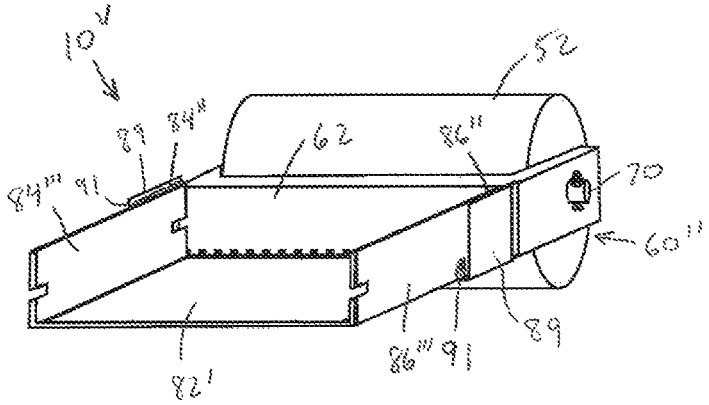
FIG. 14 is a perspective view of the putting training aid of FIG. 13.

Referring to FIGS. 13 and 14, a putting training aid 10$^{v}$ according to another embodiment of the invention will be described. The training aid 10$^{v}$ includes a weighted roller assembly 50" and permanently connected tray 80" as in the embodiment illustrated in FIGS. 10 and 11. Such assembly may be used for blade style putter heads. To convert the training aid 10$^{v}$ for a mallet style putter head, a tray support attachment $80^{iv}$ is provided which is configured to connect to and extend from the support tray 80". The tray support attachment $80^{iv}$ is similar to the tray support 80'" of FIG. 12, but rather than welding it to the bracket member 60", the tray support attachment $80^{iv}$ is removably connectable to the tray support 80". In the illustrated embodiment, a flange 89 extends from the rear edge of each of the arms 84'", 86'" and the support plate 82' to define a receiving slot 91 about the rear edge of the tray support attachment $80^{iv}$. To use the training aid $10^{v}$ with a mallet style putter, the tray support attachment $80^{iv}$ is slid onto the support tray 80", with the plate 82 and arms 84", 86" received in the receiving slot 91. The training aid $10^{v}$ may then be used with a mallet style putter in a manner described above.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A putting training aid comprising:

a weighted roller assembly comprising:

a bracket member; and a weighted roller mounted relative to the bracket member such that the roller is rotatable about a central axis relative to the bracket member, the roller having a weight of at least 18 ounces and having an outer surface which defines a rolling surface configured to roll along a putting surface; and a connection configured for connection of a putter shaft to the bracket member, wherein the connection is through a support tray attached to the bracket member, the support tray is configured to securably receive a putter head thereon with the putter shaft attached to the putter head.

2. The putting training aid according to claim 1 wherein the support tray is removably attached to the bracket member.

3. The putting training aid according to claim 1 wherein the support tray is permanently attached to the bracket member.

4. The putting training aid according to claim 1 wherein the support tray includes a support plate with a rear edge extending along a face of the bracket member and an opposite front edge.

5. The putting training aid according to claim 4 wherein a distance from the rear edge to the front edge is smaller than a depth of the putter head to be securably received thereon.

6. The putting training aid according to claim 5 wherein the putter head to be securably received thereon is a blade style putter head.

7. The putting training aid according to claim 5 wherein the putter head to be securably received thereon is a mallet style putter head.

8. The putting training aid according to claim 1 further comprising an attachment mechanism for securing a putter head to the support tray.

9. The putting training aid according to claim 8 wherein the attachment mechanism is at least one strap configured to be secured about the bracket member and the support tray.

10. The putting training aid according to claim 8 wherein the attachment mechanism is at least one elastic band configured to be stretchedly secured across the support tray.

11. A putting training aid comprising:

a weighted roller assembly comprising:

a bracket member; and a weighted roller mounted relative to the bracket member such that the roller is rotatable about a central axis relative to the bracket member, the roller having a weight of at least 18 ounces;

a support tray attached to the bracket member such that the support tray is forward the weighted roller, the support tray defining a receiving area configured to receive a putter head therein; and an attachment mechanism configured to secure a putter head received within the receiving area.

12. The putting training aid according to claim 11 wherein the support tray is removably attached to the bracket member.

13. The putting training aid according to claim 11 wherein the support tray is permanently attached to the bracket member.

14. The putting training aid according to claim 11 wherein the attachment mechanism is at least one strap configured to be secured about the bracket member and the support tray.

15. The putting training aid according to claim 11 wherein the attachment mechanism is at least one elastic band configured to be stretchedly secured across the support tray.

16. The putting training aid according to claim 11 wherein the receiving area is configured to receive a blade style putter head such that a face of the putter head is beyond a front edge of the support tray.

17. The putting training aid according to claim 11 wherein the receiving area is configured to receive a mallet style putter head such that a face of the putter head is beyond a front edge of the support tray.

* * * * *